US007156493B2

(12) United States Patent
Ishikawa

(10) Patent No.: US 7,156,493 B2
(45) Date of Patent: Jan. 2, 2007

(54) DROPLET EJECTING APPARATUS THAT CONTAINS AN ACTUATOR PLATE HAVING A COMMUNICATION HOLE

(75) Inventor: Hiroyuki Ishikawa, Nisshin (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 247 days.

(21) Appl. No.: 10/866,023

(22) Filed: Jun. 10, 2004

(65) Prior Publication Data

US 2004/0263574 A1 Dec. 30, 2004

(30) Foreign Application Priority Data

Jun. 24, 2003 (JP) ..... 2003-179871

(51) Int. Cl.
*B41J 2/04* (2006.01)

(52) U.S. Cl. ..... 347/54; 347/65

(58) Field of Classification Search ..... 347/20, 347/40, 54, 56, 63, 65, 67, 68, 70, 71
See application file for complete search history.

(56) References Cited

U.S. PATENT DOCUMENTS 5,255,016 A 10/1993 Usui et al. ..... 397/71
6,467,885 B1 * 10/2002 Tanaka et al. ..... 347/68

FOREIGN PATENT DOCUMENTS

EP 0 416 540 A2 3/1991
JP A-3-175047 7/1991

* cited by examiner

*Primary Examiner*—Juanita D. Stephens
(74) *Attorney, Agent, or Firm*—Reed Smith LLP

(57) ABSTRACT

A droplet ejecting apparatus including at least one nozzle through which a droplet of a liquid is ejected; at least one pressure chamber which communicates with the at least one nozzle and in which the liquid is stored; at least one supply chamber from which the liquid is supplied to the at least one pressure chamber; and an actuator plate having at least one actuator portion which is interposed between the at least one pressure chamber and the at least one supply chamber and which is deformable so that a volume of the at least one pressure chamber is changed. The at least one actuator portion has a communication hole which is formed through a substantially central part thereof, and the at least one pressure chamber and the at least one supply chamber communicate with each other through the communication hole.

25 Claims, 5 Drawing Sheets

DROPLET EJECTING APPARATUS THAT CONTAINS AN ACTUATOR PLATE HAVING A COMMUNICATION HOLE

The present application is based on Japanese Patent Application No. 2003-179871 filed Jun. 24, 2003, the contents of which are incorporated herein by reference.

BACKGROUND OF THE INVENTION

1. Field of the Invention

The present invention relates in general to a droplet ejecting apparatus used for an ink-jet recording apparatus, for instance. In particular, the present invention relates to such a droplet ejecting apparatus capable of ejecting a droplet of a liquid with high efficiency and preventing poor droplet ejection.

2. Discussion of Related Art

JP-A-3-175047 or its corresponding U.S. Pat. No. 5,255,016 discloses an ink jet printer recording head which includes two members that are opposed to each other with a small gap being formed therebetween into which ink is introduced. One of the two members functions as an ink pressuring member formed of a piezoelectric material, and is deformed toward the other member, so that the ink in the small gap formed between the two members is pressurized and ejected from a nozzle in the form of a droplet. FIGS. 1 through 8 of the Publication disclose a structure in which both of opposite ends of the pressuring member are fixed, and a central part of the pressuring member is arranged to be opposed to the nozzle. FIGS. 9 and 10 of the Publication disclose a structure in which one of opposite ends of the pressuring member is fixed while the other end which is not fixed serves as a free end that is arranged to be opposed to the nozzle. FIGS. 11 through 13 disclose a structure in which a plurality of pressuring members are arranged in parallel with each other such that the pressuring members are spaced apart from each other with a suitable spacing therebetween. Both of opposite ends of each pressuring member are fixed, and a nozzle is formed at a central portion of the pressuring member. The front surfaces of the pressuring members are covered with a seal body having holes so as not to prevent ejection of the ink from the nozzles. FIG. 14 of the Publication discloses a structure having a single piezoelectric member that has a plurality of nozzles. Annular electrodes are provided so as to surround each nozzle for permitting a portion of the member which surrounds the nozzle to function as the pressuring member.

In the structures disclosed in the above-identified Publication, the small gaps each corresponding to each pressuring member and each nozzle are connected to each other, in other words, the small gaps are not separated from each other. Accordingly, the pressure given by one specific pressuring member to the corresponding gap propagates to the gap(s) of the other pressuring member(s) adjacent to the above-indicated one specific pressuring member, so that there is caused a so-called "cross talk" between the gaps, making uniform droplet ejection difficult.

SUMMARY OF THE INVENTION

It is therefore an object of the present invention to provide a droplet ejecting apparatus which is capable of uniformly ejecting a droplet of a liquid while reducing the cross talk and which is compact in size.

The object indicated above may be achieved according to a principle of the present invention, which provides a droplet ejecting apparatus comprising: at least one nozzle through which a droplet of a liquid is ejected; at least one pressure chamber which communicates with the at least one nozzle and in which the liquid is stored; at least one supply chamber from which the liquid is supplied to the at least one pressure chamber; and an actuator plate having at least one actuator portion which is interposed between the at least one pressure chamber and the at least one supply chamber and which is deformable so that a volume of said at least one pressure chamber is changed. The at least one actuator portion has a communication hole which is formed through a substantially central part thereof, and the at least one pressure chamber and the at least one supply chamber communicate with each other through the communication hole.

In the droplet ejecting apparatus constructed as described above, the liquid is supplied from the at least one supply chamber to the at least one pressure chamber through the communication hole formed in the at least one actuator portion. The actuator portion of the actuator plate is deformed, so that the volume of the pressure chamber is changed, whereby the droplet of liquid is ejected from the nozzle which communicates with the corresponding pressure chamber. In the present arrangement wherein the communication hole is formed through the substantially central part of the actuator portion, the communication hole is opposed to a corresponding central part of the pressure chamber. Accordingly, the pressure of the liquid in the pressure chamber upon operation of the actuator portion can be effectively generated, so that the droplet of liquid can be ejected with high efficiency.

In the present droplet ejecting apparatus, the at least one supply chamber and the at least one pressure chamber are separated from each other by the actuator portion. Where the at least one supply chamber includes a plurality of supply chambers and the at least one pressure chamber includes a plurality of pressure chambers, the pressure generated on the side of one specific supply chamber upon operation of the actuator portion is prevented from adversely influencing adjacent pressure chambers, whereby a cross talk between the adjacent pressure chambers is reduced, avoiding various problems such as non-uniform ink ejection.

Some droplet ejecting apparatuses are constructed such that an actuator unit is bonded integrally to a separately prepared cavity unit having spaces in which liquid is stored. In such droplet ejecting apparatuses, the number of components are inevitably increased and the structure is undesirably complicated. In contrast, in the present droplet ejecting apparatus, the actuator portion is located between the pressure chamber and the supply chamber, and the actuator portion and spaces in which the liquid is stored are provided by a single integral unit. Accordingly, the present droplet ejecting apparatus allows reduction in the number of the components to be used, simplification of the structure of the apparatus, and reduction in the size of the apparatus. In the present droplet ejecting apparatus constructed as described above, the supply chamber, the pressure chamber, and the communication hole through which the supply chamber and the pressure chamber communicate with each other are substantially coaxially aligned with one another, so that the apparatus can be made in compact in size even where a plurality of supply chambers, a plurality of pressure chambers, and a plurality of communication holes are provided in the apparatus.

BRIEF DESCRIPTION OF THE DRAWINGS

The above and other objects, features, advantages and technical and industrial significance of the present invention will be better understood by reading the following detailed description of preferred embodiments of the invention, when considered in connection with the accompanying drawings, in which.

DETAILED DESCRIPTION OF THE PREFERRED EMBODIMENTS

Hereinafter, there will be described preferred embodiments of the present invention by reference to the drawings.

Figure 1:
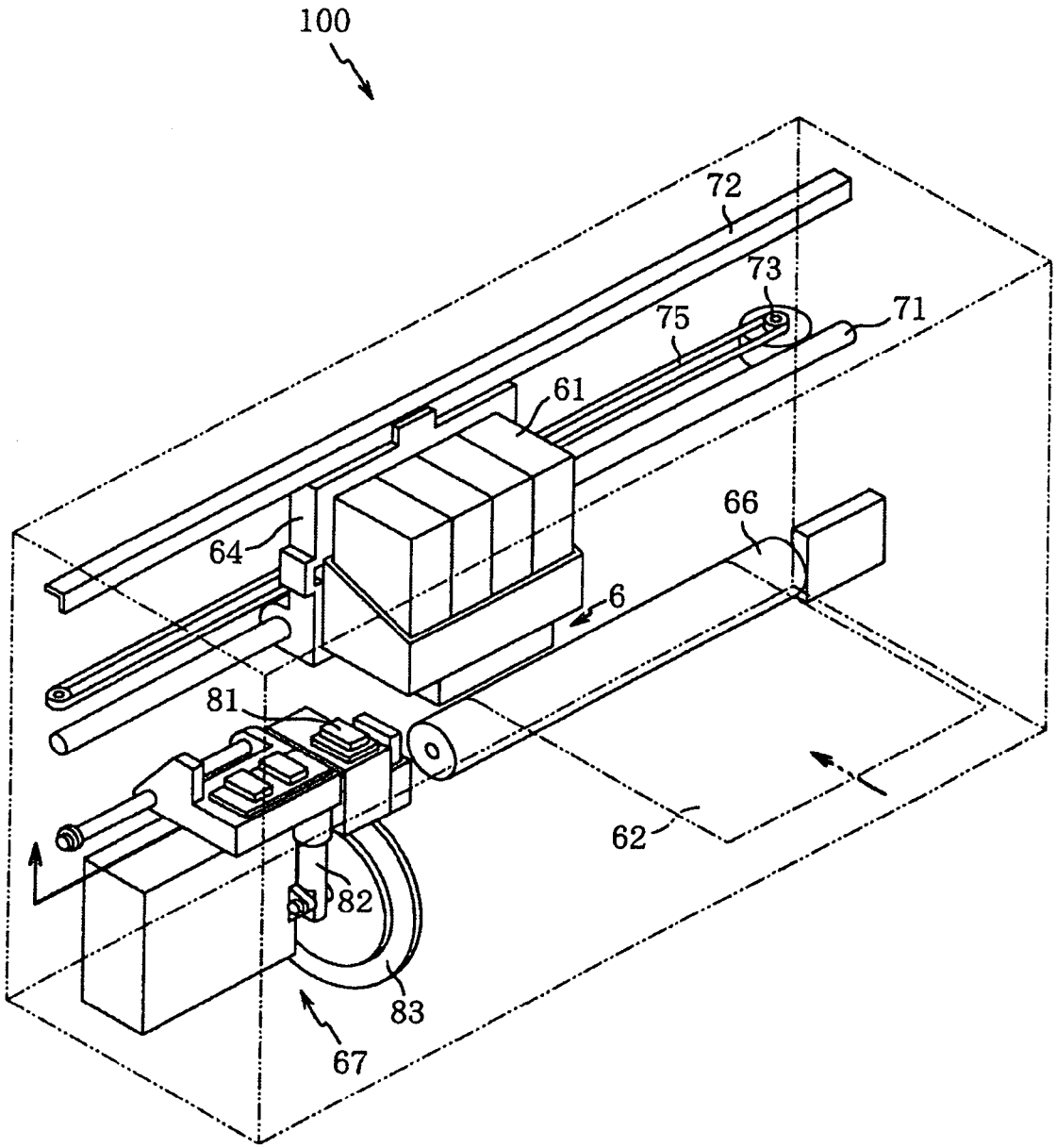
FIG. 1 is a perspective view of an ink jet recording apparatus including a piezoelectric-type ink jet recording head to which the present invention is applied.

FIG. 1 shows an ink jet recording apparatus 100 including a piezoelectric-type ink jet recording head 6 as a droplet ejecting apparatus to which the present invention is applied and which is constructed according to a first embodiment of the invention. The ink jet recording apparatus 100 will be briefly described. The piezoelectric ink jet recording head 6 is arranged to record characters and/or symbols on a recoding medium such as a sheet of paper 62, and mounted on a carriage 64, together with ink cartridges 61.

The carriage 64 is fixed to an endless belt 75, and is linearly reciprocated along a guide bar 71 and a guide plate 72 when a pulley 73 is rotated forward and backward by an electric motor. During the reciprocation of the carriage 64, droplets of ink are ejected from ink ejection nozzles 54 (FIG. 3) formed in the piezoelectric ink jet recording head 6 toward the sheet of paper 62. The paper 62 is fed from a sheet supply cassette, not shown, provided in the ink jet recording apparatus 100, to a location between the ink jet recording head 6 and a platen roller 66. After the ink jet recording head 6 records images on the paper 62, the paper 62 is discharged. A sheet feeding device and a sheet discharging device for feeding and discharging the sheet of paper 62, respectively, are not shown.

A purging device 67 is provided on one side of the platen roller 66. The purging device 67 is for removing undesirable poor-quality ink remaining in the ink jet recording head 6. Described in detail, when the carriage 64 is positioned at a resetting position, a purging cap 81 of the purging device 67 covers the surface of the recording head 6 in which the nozzles are formed, so as to form an air-tight space. Then, the air-tight space is depressurized by an air pump 82 that is operated by a cam 83. Thus, the undesirable poor-quality ink remaining the ink jet recording head 6 is removed.

Figure 2:
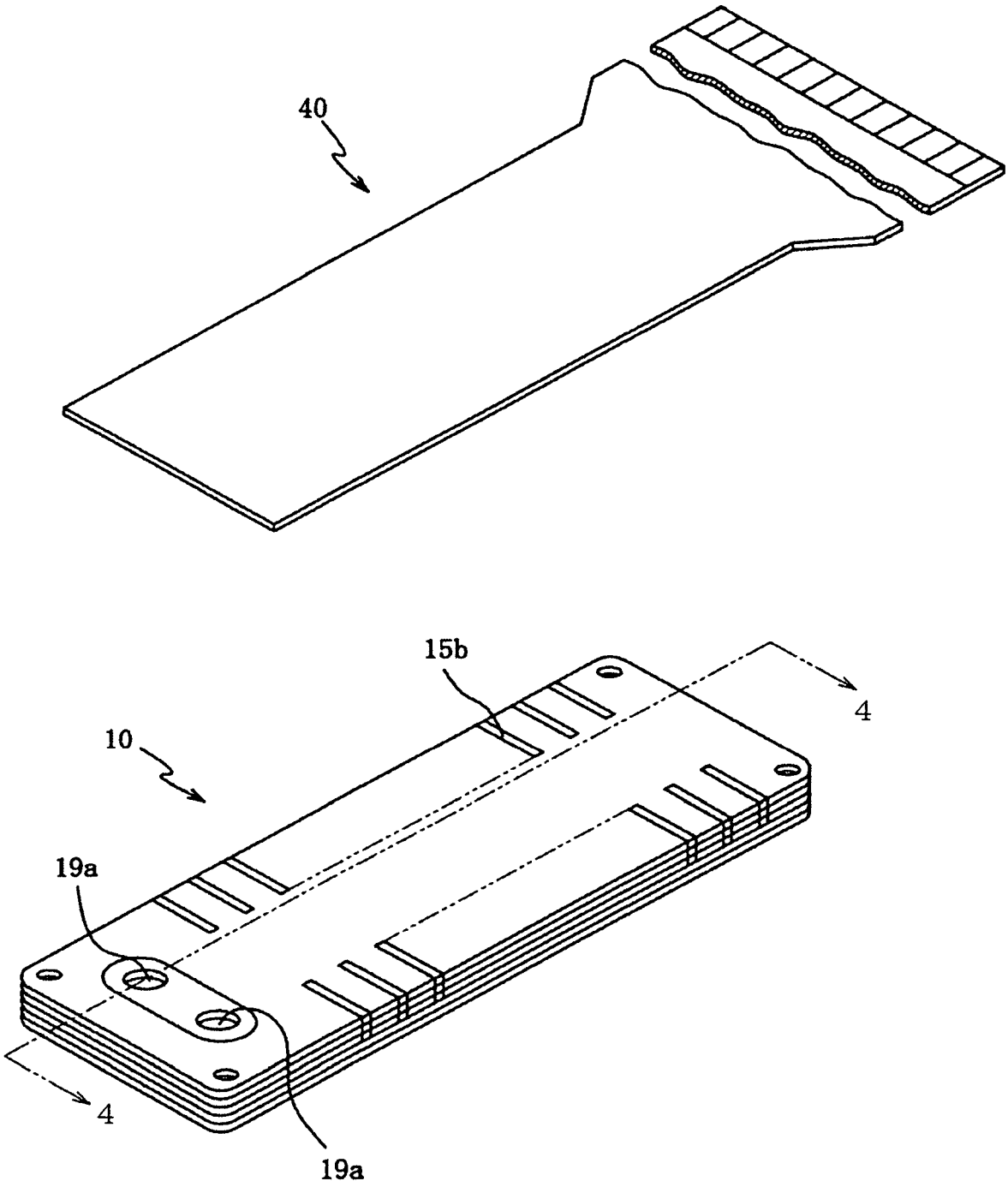
FIG. 2 is an exploded perspective view of the ink jet recording head.
Figure 3:
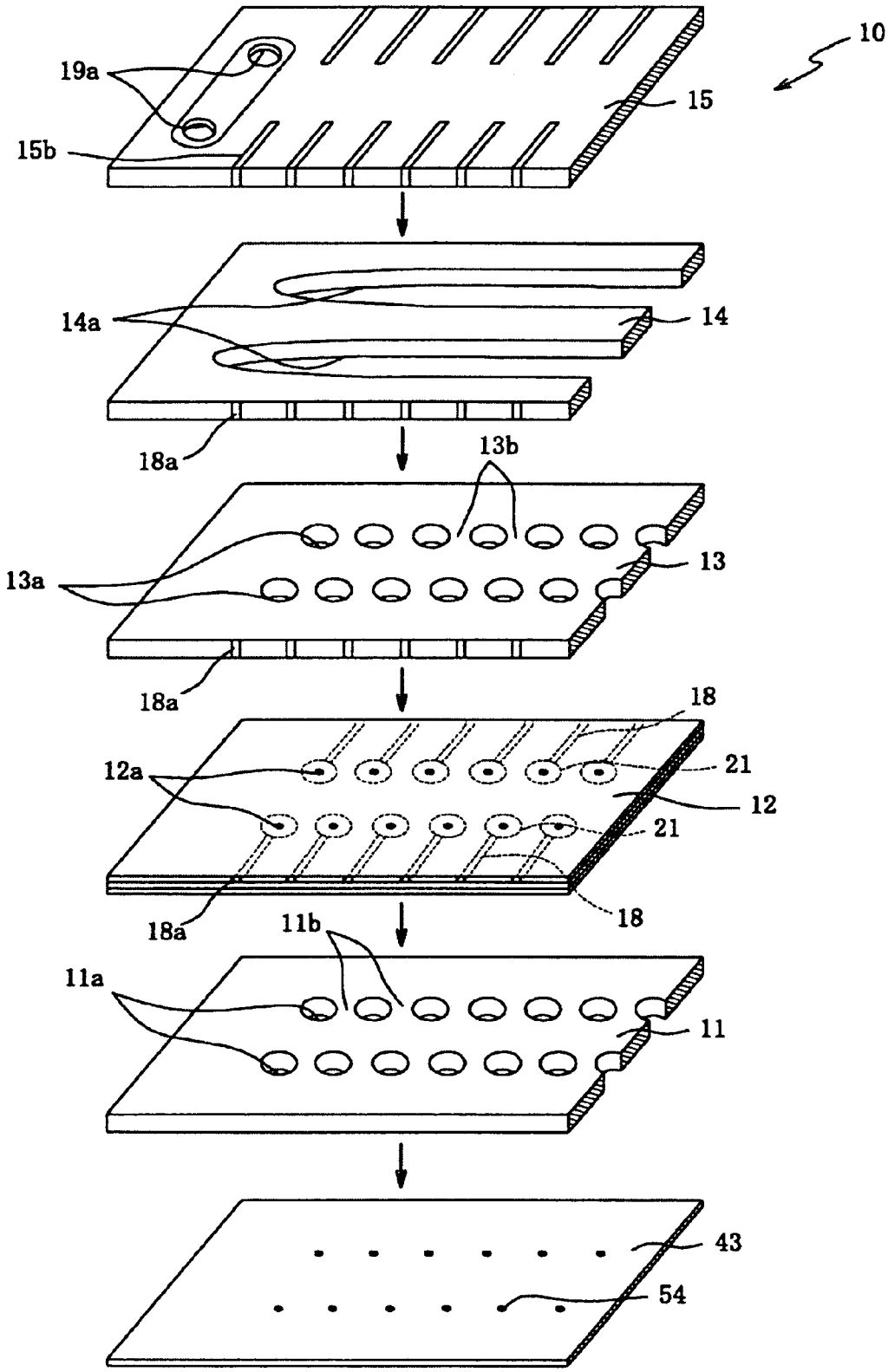
FIG. 3 is an exploded perspective view of a cavity unit of the ink jet recording head of FIG. 2.

Referring next to FIGS. 2 and 3, there will be described a structure of the piezoelectric ink jet recording head 6. As shown in FIG. 2, the piezoelectric ink jet recording head 6 includes a cavity unit 10 having a stacked or laminar structure for storing ink, and a flexible flat cable 40 superposed on and bonded to an upper surface of the cavity unit 10 for electrical connection. When a command of printing is made, an electric power is supplied to the ink jet recording head 6 via the flexible flat cable 40, so that the ink jet recording head 6 outputs the ink downward from the nozzles 54 that are open in a lower surface of the cavity unit 10.

The cavity unit 10 has the stacked structure including a plurality of plates which are stacked on and integrally bonded or diffusion-bonded to one another.

As shown in the exploded perspective view of FIG. 3, the stacked structure of the cavity unit 10 consists of six plates which are stacked on one another, i.e., a nozzle plate 43, a cavity plate 11, an actuator plate 12, a supply plate 13, a manifold plate 14, and a closure plate 15. In the present embodiment, the plates 11, 13, 14, and 15 except the nozzle plate 43 and the actuator plate 12 have a thickness in a range of about 20 μm to about 150 μm. The stacked structure of the cavity unit 10 will be described below in detail.

Figure 4A:
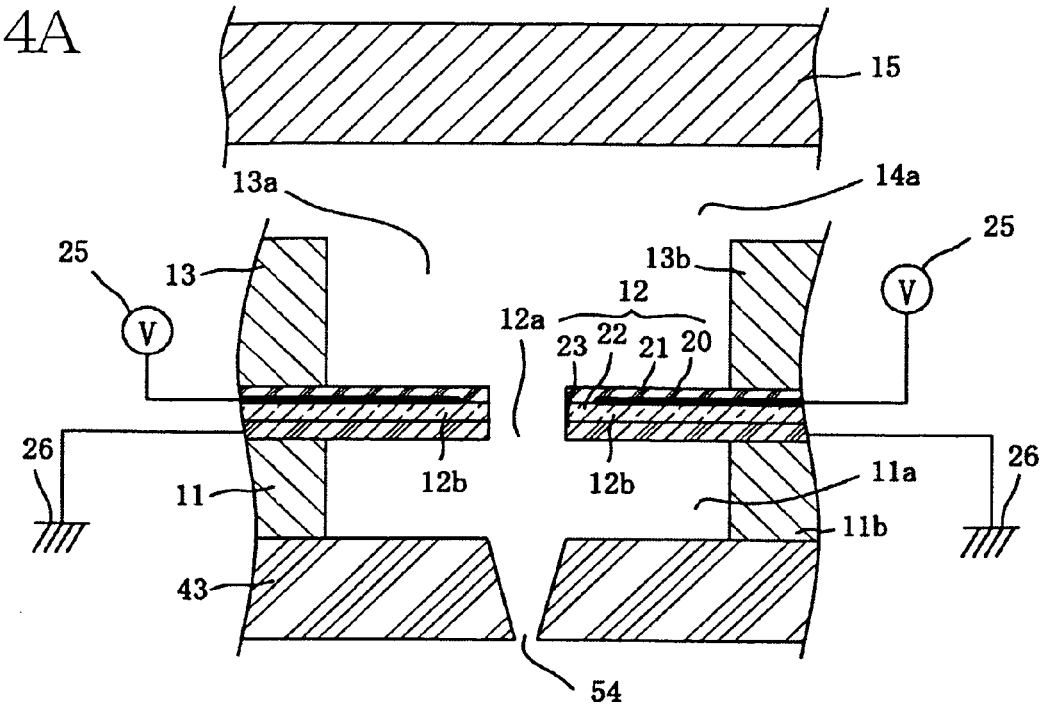
FIGS. 4A and 4B are fragmentary, cross sectional views schematically showing the piezoelectric-type ink jet recording head of FIG. 2, taken along line 4—4 of FIG. 2.
Figure 4B:
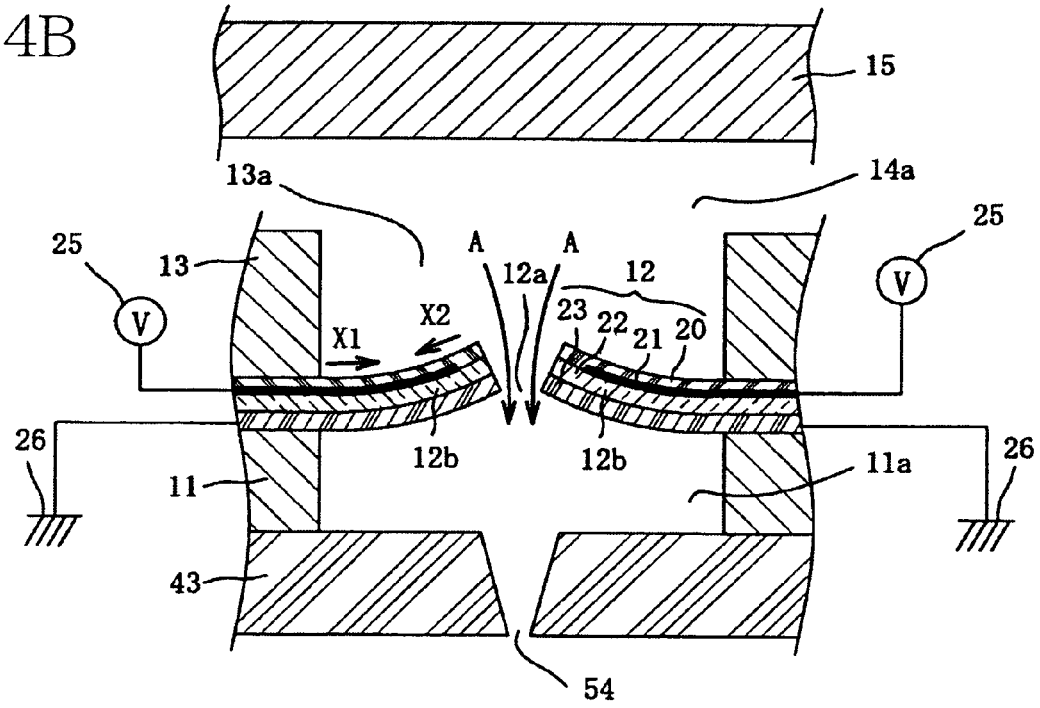

The nozzle plate 43 as the lowermost plate of the cavity unit 10 is a plate member formed of synthetic resin. The nozzle plate 43 is formed with a multiplicity of ink ejection nozzles 54 each having an extremely small diameter. The nozzles 54 are formed through the thickness of the nozzle plate 43, in two straight rows extending in the longitudinal direction of the nozzle plate 43 such that the nozzles 54 of each row are equally spaced apart from each other at a relatively small spacing pitch. Thus, the nozzles 54 are formed in a lattice pattern. In the present embodiment, as shown in FIGS. 4A and 4B, each nozzle 54 has a transverse cross sectional area which increases from one of its axially opposite ends that is remote from the corresponding pressure chamber 11*a* toward the other of the axially opposite ends that is on the side of the pressure chamber 11*a*.

The cavity plate 11 stacked on the upper surface of the nozzle plate 43 is formed with a multiplicity of openings (11*a*) which are formed through the thickness thereof and which provides a multiplicity of pressure chambers 11*a*. The pressure chambers 11*a* are respectively aligned with the nozzles 54 formed in the nozzle plate 43 and have a generally cylindrical shape.

The actuator plate 12 is for changing the volume of the pressure chambers 11*a*, so that the droplets of the ink are ejected from the nozzles 54. The actuator plate 12 is a piezoelectric-type actuator which is deformed by application of a voltage thereto. As shown in FIGS. 4A and 4B, the actuator plate 12 of the present embodiment has a three-layered structure including a metal sheet in the form of an oscillating plate 23, a piezoelectric film 22 which is provided on the upper surface of the oscillating plate 23 (i.e., on one of opposite surfaces of the oscillating plate 23 which is remote from the pressure chambers 11*a*) and which oscillates the oscillating plate 23, and an electrically insulating sheet 20 which is provided on the upper surface of the piezoelectric film 22. The structure of the actuator plate 12 will be described below in detail.

The oscillating plate 23 of the actuator plate 12 is formed of a stainless steel sheet having a thickness in a range of about 2 μm to about 50 μm. The oscillating plate 23 of the present embodiment has a thickness of 30 μm.

The piezoelectric film 22 is formed on the upper surface of the oscillating plate 23 by using, as a major component, lead zirconium titanate (hereinafter simply referred to as "PZT") which is solid solution of lead titanate and lead zirconate and which is ferroelectric. In the present embodiment, the piezoelectric film 22 has a thickness of about 5 μm. The piezoelectric film 22 is formed on the oscillating plate 23 by various methods such as screen printing of paste-like PZT, an aerosol deposition method in which a gas flow including particles of the PZT is blown at a high speed onto the oscillating plate 23, a chemical vapor deposition method, a sputtering method, a sol-gel processing, an electrolytic deposition method, and hydrothermal synthesis. The ferroelectric PZT is polarized, by application of a voltage thereto, in one specific direction, and is kept in a polarized state after the application of the voltage is stopped. When a voltage is applied to the polarized PZT, the PZT is given a strain. In the present embodiment, the PZT (piezoelectric film 22) is subjected to the polarization treatment such that the direction of the polarization of the piezoelectric film 22 is perpendicular to the plane of the oscillating plate 23.

In the thus formed stacked structure of the actuator plate 12 in which the piezoelectric film 22 and the electrically insulating sheet 23 (which will be described) are stacked on the upper surface of the oscillating plate 23, a plurality of communication holes 12*a* each as an ink flow passage are formed through the thickness of the stacked structure of the actuator plate 12 by a suitable method such as laser machining. Alternatively, prior to stacking, on the oscillating plate 23, of the piezoelectric film 22 and the insulating sheet 20, the oscillating plate 23 may be formed with the communication holes 12*a* by laser machining, etching, etc.

The plurality of communication holes 12*a* are formed in the actuator plate 12 such that each of the communication holes 12*a* is substantially coaxially opposed to a corresponding one of the plurality of nozzles 54 formed in the nozzle plate 43. Each communication hole 12*a* has a circular shape in transverse cross section. The communication holes 12*a* are formed such that each communication hole 12*a* is opposed to a substantially central part of the corresponding pressure chamber 11*a*, as seen in a plane of the pressure chamber 11*a*, and such that each communication hole 12*a* has a transverse cross sectional area (a diameter in the present embodiment) which is smaller than that of the pressure chamber 11*a*. Where the diameter of the communication hole 12*a* is smaller than that of the pressure chamber 11*a*, the ink can be flown into the pressure chamber 11*a* with high efficiency when an actuator or active portion 12*b* (which will be described in greater detail) is deformed and accordingly the volume of the pressure chamber 11*a* is increased. Further, the pressure of the ink is prevented from propagating from the pressure chamber 11*a* to the supply chamber 13*a* when the actuator portion 12*b* returns to its original or initial state or position upon stopping of the application of the voltage to the piezoelectric film 22 described above and accordingly the volume of the pressure chamber 11*a* is returned to the original value. The transverse cross sectional area of each communication hole 12 is preferably not larger than 1/10 of the transverse cross sectional area of the pressure chamber 11*a*, more preferably not larger than 1/30, still more preferably not larger than 1/50, and most preferably not larger than 1/100.

On the upper surface of the piezoelectric film 22 (on one of its opposite surfaces that is remote from the oscillating plate 23), a plurality of individual electrodes 21 are provided so as to correspond to the respective pressure chambers 11*a* which are located below the piezoelectric film 22 as seen in the direction of stacking of the stacked structure of the actuator plate 12. In the present embodiment, each individual electrode 21 has an annular shape having an outside diameter which is slightly smaller than the diameter of the corresponding pressure chamber 11*a* and an inside diameter which is slightly larger than the diameter of each communication hole 12*a* formed through the actuator plate 12.

The individual electrodes 21 are formed on the piezoelectric film 22 in the following manner, for instance: The upper surface of the piezoelectric film 22 is covered with a masking member which is patterned such that the masking member has through-holes corresponding to the individual electrodes 21 to be formed in alignment with the respective pressure chambers 11*a*. Then, paste of electrode is printed on the masking member patterned as described above to form the individual electrodes 21. Alternatively, after paste of metal is printed on the entirety of the upper surface of the piezoelectric film 22 or after an electrode layer is formed on the entirety of the upper surface by sputtering or deposition, unnecessary portions may be removed by laser machining, for instance, for permitting the remaining portions to function as the individual electrodes 21.

Each of the individual electrodes 21 has a wiring pattern 18 through which the voltage is supplied to the corresponding individual electrode 21. As shown in FIG. 3, the wiring pattern 18 extends from the individual electrode 21 in a direction toward one of opposite long side edges of the actuator plate 12, and the leading end of the wiring pattern 18 is arranged to be electrically connected to a corresponding one of wiring patterns 18*a* each of which extends from one of widthwise opposite end faces of the actuator plate 12 in a direction toward the top of the cavity unit 10 remote from the nozzle plate 43.

The electrically insulating sheet 20 provided on the upper surface of the piezoelectric film 22 is for preventing electrical connection and physical contact between the individual electrodes 21 and the ink. The insulating sheet 20 has a certain degree of flexibility and is formed of an electrically insulating material such as rubber or plastic. As described above, the communication holes 12*a* may be formed through the three-layered structure of the actuator plate 12 in which the oscillating plate 23, the piezoelectric film 22, and the insulating sheet 20 are stacked on one another. Alternatively, the insulating sheet 20 may be formed with a plurality of through-holes each having a size that is substantially equal to that of each communication hole 12*a* formed in the oscillating plate 23 and the piezoelectric film 22. The thus formed insulating sheet 20 covers the individual electrodes 21. Depending upon the kind of the ink to be used, the insulating sheet 20 may be eliminated.

In the thus constructed actuator plate 12 wherein the piezoelectric film 22 is formed on the oscillating plate 23 and the individual electrodes 21 are provided on the piezoelectric film 22 so as to correspond to the respective pressure chambers 11*a*, the piezoelectric film 22 is interposed between the individual electrodes 21 and the oscillating plate 23. Since the oscillating plate 23 is formed of an electrically conductive metallic material, the oscillating plate 23 functions as a common electrode which is common to all of the plurality of pressure chambers 11*a*.

The description goes back to the structure of the cavity unit 10.

The supply plate 13 stacked on the upper surface of the actuator plate 12 is formed with a plurality of openings (13*a*) so as to respectively correspond to the plurality of nozzles 54 formed in the nozzle plate 43. The plurality of opening (13*a*) provide the supply chamber 13*a* each having a substantially cylindrical shape. Each supply chamber 13*a* has a transverse cross sectional shape that is substantially equal to that of each pressure chamber 11*a* formed in the cavity plate 11. In the stacked structure of the cavity unit 10, the actuator plate 12 is sandwiched by and between partition walls 11*b* surrounding the pressure chambers 11*a* and partition walls 13*b* surrounding the supply chambers 13*a*, as shown in FIGS. 4A and 4B, and the plurality of pressure chambers 11*a* communicate with the plurality of supply chambers 13*a*, respectively, through the respective communication holes 12*a*.

The manifold plate 14 stacked on the upper surface of the supply plate 13 is formed with a pair of elongate openings (14*a*) each of which provides a manifold chamber 14*a* functioning as an ink passage. The two manifold chambers 14*a*, 14*a* extend in the longitudinal direction of the manifold plate 14 such that the two manifold chambers 14*a*, 14*a* are respectively aligned with the two rows of the supply chambers 13*a* in a plan view of the manifold plate 14 and the supply plate 13*a*.

The closure plate 15 stacked on the upper surface of the manifold plate 14 is formed with, at one of its longitudinally opposite end portions, supply holes 19*a*, 19*a* which respectively communicate with the manifold chambers 14*a*, 14*a*.

In the thus constructed cavity unit 10, the ink supplied from the ink cartridge 61 to the manifold chambers 14*a*, 14*a* via the supply holes 19*a*, 19*a* is distributed to the supply chambers 13*a*, then supplied to the pressure chambers 11*a* via the respective communication holes 12*a* of the actuator plate 12, and finally reach the nozzles 54 corresponding to the pressure chambers 11*a*. On the upper surface of the closure plate 15, there are formed wiring patters 15*b* which respectively correspond to the individual electrodes 21. In a state in which the actuator plate 12, the supply plate 13, the manifold plate 14, and the closure plate 15 are stacked on and bonded to one another, the wiring patterns 18*a* formed by printing, for instance, extend on the widthwise opposite end faces of those plates such that each wiring pattern 18*a* connects the corresponding wiring pattern 18 of the actuator plate 12 to the corresponding wiring pattern 15*b* of the closure plate 15.

The flexible flat cable 40 is superposed on the closure plate 15. The flexible flat cable 40 has a wiring pattern (not shown) connected to a signal source and a power source. The wiring pattern of the flexible flat cable 40 is electrically connected to the individual electrodes 21 via the wiring patterns 15*b*, 18*a*, 18.

By applying a voltage which is higher than that applied when a normal ink ejecting operation is conducted, between the all of the individual electrodes 21 and the oscillating plate 23, portions of the piezoelectric film 22 interposed between the respective individual electrodes 21 and the oscillating plate 23 are polarized in a direction from the upper surface of the piezoelectric film 22 toward the oscillating plate 23. Accordingly, each of the portions of the piezoelectric film 22 which have been polarized functions as the actuator portion 12*b* or active portion which is given a strain upon application, thereto, of the voltage for ink ejecting operation. Each of the actuator portion 12*b* has the communication hole 12*a* described above.

Referring next to FIGS. 4A and 4B, there will be described the ink ejecting operation conducted by the piezoelectric ink-jet recording head 6 constructed as described above.

FIGS. 4A and 4B are fragmentary, cross sectional views schematically showing the piezoelectric ink jet recording head 6 of FIG. 2, taken along line 4—4 of FIG. 2. FIG. 4A shows a state in which no voltage is applied to the selected individual electrode 21 and the oscillating plate 23 as the common electrode while FIG. 4B shows a state in which a voltage is applied to the selected individual electrode 21 and the oscillating plate 23.

As described above with respect to FIG. 3, the ink is filled in the space, within the cavity unit 10, constituted by the manifold chambers 14*a*, supply chambers 13*a* and pressure chambers 11*a*, and the ink reaches in the vicinity of the opening of each nozzle 54 formed in the nozzle plate 43.

As shown in FIG. 4A, a space of the pressure chamber 11*a* is made smaller than a space constituted by a portion of the manifold chamber 14*a* and the corresponding supply chamber 13*a*. Further, each manifold chamber 14*a* has the elongate shape extending in the longitudinal direction of the manifold plate 14. Accordingly, an easy flow of the ink is assured in the space located above the actuator portion 12*b*.

In the present embodiment, the oscillating plate 23 functioning as the common electrode is connected to the ground 26 while the selected individual electrode 21 is connected to a positive voltage power source 25 via the flexible flat cable 40. Thus, an electric field is produced in the corresponding actuator portion 12*b* in the same direction as the direction of polarization thereof, so that the actuator portion 12*b* contracts in a direction perpendicular to the direction of polarization (namely, in opposite two directions indicated by arrows X1, X2 in FIG. 4B). In this case, since the oscillating plate 23 does not contract, the actuator portion 12*b* is deformed in a direction parallel to the direction of stacking thereof. In other words, the actuator portion 12*b* is curved toward the corresponding supply chamber 13*a* namely, deformed into a convex shape that is substantially symmetrical with respect to the axis of the communication hole 12*a* of the actuator portion 12*b*, as shown in FIG. 4A. As a result, the volume of the pressure chamber 11*a* is increased, and the pressure chamber 11*a* is depressurized, so that the ink in the supply chamber 13*a* is flown into the pressure chamber 11*a* (in a direction indicated by arrows A in FIG. 4B). When the application of the voltage is stopped, the deformed actuator portion 12*b* returns to its original state shown in FIG. 4A, so that the pressure of the ink in the pressure chamber 11*a* is increased and the pressure of the ink is transmitted to the corresponding nozzle 54, whereby the droplet of the ink is ejected from the nozzle 54. After the droplet of the ink is ejected from the nozzle 54, the pressure of the ink in the pressure chamber 11*a* returns to its normal or original value, and the ink is supplied from the manifold chamber 14*a* to the supply chamber 13*a*.

The actuator portion 12*b* is preferably arranged to return to its original state when the pressure generated in the pressure chamber 11*a* upon increase of its volume is increased toward the positive side in the variation according to the natural frequency of the ink in the pressure chamber 11*a*. By this arrangement, the pressure increased toward the positive side and the pressure generated when the actuator portion 12*b* returns to its original state are added together, so that the pressure of the ink can be effectively increased, resulting in efficient ink ejection.

In the ink jet recording head 6 constructed as described above wherein the actuator portion 12*b* is provided by the stacked structure in which the piezoelectric film 22 and the non-piezoelectric sheets (i.e., the oscillating plate 23 and the insulating sheet 20) are stacked on one another, the non-piezoelectric sheets are also deformed, upon application of the voltage to the piezoelectric film 22, together with the piezoelectric film 22, so that the entirety of the actuator portion 12*b* is deformed, by deformation of the piezoelectric film 22 in the direction perpendicular to the direction of stacking, into the convex shape which protrudes toward the corresponding supply chamber 13*a* and which is substantially symmetrical with respect to the axis of the communication hole 12*a*. The present arrangement permits effective operation of the actuator portion 12*b* with application of a relatively low voltage thereto, as compared with an arrangement in which a plate without communication holes is curved or deformed. Further, since the communication hole 12*a* is formed through the substantially central part of the actuator portion 12*b* so as to be opposed to the corresponding central part of the pressure chamber 11*a*, when the actuator portion 12*b* is deformed, the ink can be effectively flown into the pressure chamber 11*a* and the ink can be effectively compressed, so that the ink pressure is effectively increased. Where the nozzle 54 is located so as to be coaxial with respect to the axes of the communication hole 12*a* and the pressure chamber 11*a*, the ink in the chamber 11*a* can be ejected from the nozzle 54 with high efficiency.

In the ink jet recording head 6 constructed as described above, the upper space which is constituted by a portion of the manifold chamber 14*a* and the supply chamber 13*a* and which is located above the actuator portion 12*b* has a size considerably larger than that of the space of the pressure chamber 11*a*. Accordingly, when the pressure of the ink in the above-described upper space is increased by deformation of the corresponding actuator portion 12*b*, this arrangement is effective to prevent the increased pressure of the ink in the upper space from adversely influencing on adjacent pressure chambers 11*a*, thereby preventing undesirable poor printing.

In the ink jet recording head 6 of the present embodiment, the actuator plate 12 is interposed between the cavity plate 11 and the supply plate 13, so that each actuator portion 12*b* is sandwiched by and between the partition walls 11*b* of the cavity plate 11 and the partition walls 13*a* of the supply plate 13. According to this arrangement, even when the selected actuator portion 12*b* is curved or deformed and accordingly undergoes a strain, the actuator portion 12*b* located adjacent to the deformed actuator portion 12*b* is not influenced by the strain. Further, since each supply chamber 13*a* and each pressure chamber 11*a* are separated from each other by the corresponding actuator portion 12*b*, the positive pressure generated in the selected pressure chamber 11*a* is prevented from propagating via the communication hole 12*a* of the corresponding actuator portion 12*b* to the other pressure chambers 11*a*. In the present arrangement wherein the plurality of pressure chambers 11*a* are independent from each other, the pressure wave produced in the selected pressure chamber 11*a* does not propagate directly to the other pressure chambers 11*a*, so as to prevent a cross talk between the adjacent pressure chambers 11*a*. Accordingly, the poor printing can be effectively prevented.

In the present ink jet recording head 6 constructed as described above, each of the plurality of nozzles 54 and each of the plurality of communication holes 12*a* are substantially coaxially opposed to each other via the corresponding pressure chamber 11*a*. This arrangement assures effective and smooth ink flow from the supply chamber 13*a* into the pressure chamber 11*a* and effective and smooth ejection of the ink in the pressure chamber 11*a* from the corresponding nozzle 54.

Figure 5:
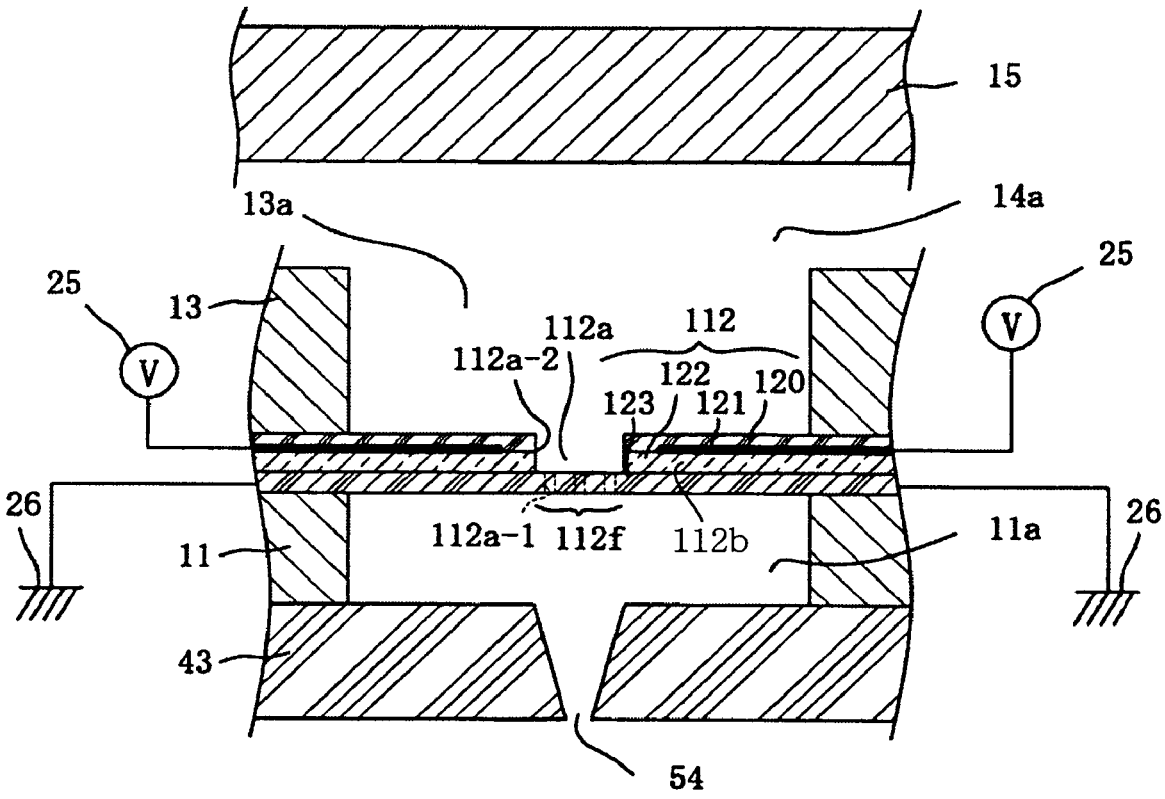
FIG. 5 is a fragmentary, cross sectional view schematically showing a piezoelectric-type ink jet recording head constructed according to another embodiment of the invention.

Referring next to FIG. 5, there will be described a piezoelectric ink jet recording head 6 constructed according to a second embodiment of the invention. The ink jet recording head 6 of this second embodiment differs from the ink jet recording head 6 of the first embodiment in the structure of the actuator plate. Accordingly, except the actuator plate, the same reference numerals as used in the second embodiment are used to identify the corresponding components and a detailed explanation of which will not be given below to avoid a redundant description.

In the ink-jet recording head 6 of the second embodiment, the actuator plate indicated at 112 in FIG. 5 has a plurality of communication holes 112*a* each of which is constituted by a plurality of through-holes 112*a*-1 each having a diameter smaller than that of the nozzle 54. Preferably, the plurality of through-holes 112*a*-1 are formed through the oscillating plate 123. In this case, the insulating sheet 120 and the piezoelectric film 122 are formed with a plurality of openings 112*a*-2 each of which has a size that permits the plurality of through-holes 112*a*-1 formed in the oscillating plate 123 to be enclosed in the opening 112*a*-2, in a plan view of the plate 123, the film 122 and the sheet 120. The plurality of through-holes 112*a*-1 function as a filter 112*f* for removing foreign matters included in the ink supplied from the supply holes 19*a*. This arrangement is effective to prevent the nozzles 54 from being clogged with the foreign matters, so that the poor ink ejection can be prevented with high reliability.

As in the illustrated first embodiment, the ink ejection is conducted by applying a voltage between the selected individual electrode 121 and the oscillating plate 123. In the recording head 6 of the second embodiment, the plurality of through-holes 112*a*-1 each having a small diameter are densely formed, so that the total of transverse cross sectional areas of the plurality of through-holes 112*a*-1 is larger than a transverse cross sectional area of the communication hole 12*a* and that the rigidity of the oscillating plate 123 is lowered as compared with that of the oscillating plate 23 in the illustrated first embodiment. In view of this, the ink ejecting operation of the ink-jet recording head 6 of the second embodiment is conducted by applying a voltage lower than that in the first embodiment.

The ink jet recording head 6 constructed according to the second embodiment also enjoys the advantages described above with respect to the ink jet recording head 6 of the first embodiment. For instance, the ink jet recoding head 6 assures effective deformation of the actuator portion 112*b* into the convex shape, smooth flow of the ink, and reduction of the cross talk between the adjacent pressure chambers 11*a*.

While the preferred embodiments of the present invention have been described above, for illustrative purpose only, it is to be understood that the invention is not limited to the details of the illustrated embodiments, but may be embodied with various changes, modifications and improvements, which may occur to those skilled in the art, without departing from the spirit and scope of the invention defined in the attached claims.

For instance, the illustrated embodiments employ a so-called "fill-before-fire" method in which the ink droplet is ejected when the actuator portion which has been deformed returns to its original state. However, a so-called "fire-before-fill" method may be employed in which the ink droplet is ejected by displacement of the actuator portion. In other words, the direction of polarization and the direction of electric field produced upon application of the voltage may be changed depending upon the construction of the piezoelectric ink jet recording head 6.

In the illustrated embodiments, the plurality of supply chambers 13*a* are formed so as to correspond to the plurality of pressure chambers 11*a*, respectively. The supply chambers 13*a* may be in the form of two elongate chambers which are similar to those of the manifold chambers 14*a* and which extend in the longitudinal direction of the supply plate 13 such that the two supply chambers 13*a* are respectively aligned with the two rows of the pressure chambers 11*a*. Alternatively, the supply plate 13 in which the plurality of supply chambers 13*a* are formed may be eliminated, and the manifold chambers 14*a* of the manifold plate 14 may function as the supply chambers 13*a*.

In the illustrated embodiments, the actuator portion 12*b*, 112*b* is deformed, upon application of the voltage thereto, into the convex shape which protrudes toward the supply chamber 13*a*, and then returns to its original state upon stopping of the application of the voltage, so that the ink droplet is ejected from the nozzle 54. The actuator portion may be arranged such that the actuator portion is deformed into the convex shape which protrudes toward the pressure chamber 11*a*. Further, the actuator portion may be arranged such that, after the actuator portion has been deformed into the convex shape which protrudes toward the supply chamber 13*a*, the actuator portion is deformed into a convex shape which protrudes toward the pressure chamber 11*a*, and then returns to its original state after the ink droplet is ejected. Moreover, the actuator portion may be arranged such that, after the actuator portion has been deformed into the convex shape which protrudes toward the pressure chamber 11*a* to thereby eject the ink droplet, the actuator portion is deformed into the convex shape which protrudes toward the supply chamber 13*a*, and then returns to its original state.

In the ink jet recoding head 6 constructed according to the illustrated embodiments, the communication hole 12*a* formed in the actuator portion 12*b* has a size that is so determined as to restrict, upon application of positive pressure to the ink in the pressure chamber 11*a* by operation of the actuator portion 12*b*, propagation of the pressure from the pressure chamber 11*a* to the supply chamber 13*a*. Accordingly, the pressure generated in the pressure chamber 11*a* is prevented from influencing adjacent pressure chambers 11*a* via the supply chamber 13*a*. In other words, the cross talk between the adjacent pressure chambers 11*a* can be reduced, so that the ink jet recording head 6 is capable of uniformly ejecting the ink.

In the ink jet recoding head 6 constructed according to the illustrated embodiments, the actuator plate 12 is interposed between the cavity plate 11 and the supply plate 13, so that the actuator plate 12 is fixedly positioned between the two plates 11, 13. This arrangement is effective to prevent the mechanical strain generated in the actuator portion 12*b* corresponding to a selected one pressure chamber 11*a* when the actuator potion 12*b* is operated, from influencing other actuator portions 12*b* corresponding to other pressure chambers 11*a* adjacent to the selected one pressure chamber 11*a*. In other words, the mechanical cross talk can be reduced, so that the present ink jet recording head 6 is capable of uniformly ejecting the ink droplet. Further, the ink passages through which the ink flows can be simply formed by stacking the plurality of plates.

In the present ink jet recording head 6 constructed according to the illustrated embodiments, the cavity plate 11 has the plurality of pressure chambers 11*a*, the actuator plate 12 has the plurality of actuator portions 12*b* which respectively correspond to the plurality of pressure chambers 11*a*, the plurality of supply chambers 13*a* of the supply plate 13 communicate with the plurality of pressure chambers 11*a* through the respective communication holes 12*a* of the plurality of actuator portions 12*b*, and the plurality of nozzles 54 formed in the nozzle plate 43 are provided for the plurality of pressure chambers 11*a*, respectively. In the thus constructed ink jet recording head 6, the ink ejection is conducted at plurality of portions of the head 6 corresponding to the nozzles 54. Further, this arrangement permits easy manufacture of the ink jet recording head 6 as the droplet ejecting apparatus in which the plurality of nozzles 54 are located with high positional accuracy, by stacking the plurality of plates.

In the present ink jet recording head 6 constructed according to the illustrated embodiments, the supply chamber 13*a* and the communication hole 12*a* through which the supply chamber 13*a* and the pressure chamber 11*a* communicate with each other are located on respective planes different from the plane on which the pressure chamber 11*a* is located. In other words, the supply chamber 13*a*, the communication hole 12*a*, and the pressure chamber 11*a* are aligned with each other in the axial direction of the ink jet recording head 6 (i.e., in the direction of stacking of the plates 11, 12, 13), thereby avoiding an increase in the size of the ink jet recording head 6 in the transverse direction perpendicular to the axial direction and accordingly resulting in reduction in the size of the ink jet recording head 6. Further, the present arrangement permits easy manufacture of the ink jet recording head 6 as the droplet ejecting apparatus in which the plurality of nozzles 54 are located with high positional accuracy, by stacking the plurality of plates. In the ink jet recording head 6 constructed as described above, the actuator portions 12*b* are operated upon application of voltage to the selected individual electrodes 21 and the common electrode, so that the ink ejection is conducted at plurality of portions of the head 6 corresponding to the nozzles 54.

What is claimed is:

1. A droplet ejecting apparatus comprising:

at least one nozzle through which a droplet of a liquid is ejected;

at least one pressure chamber which communicates with said at least one nozzle and in which the liquid is stored;

at least one supply chamber from which the liquid is supplied to said at least one pressure chamber; and an actuator plate having at least one actuator portion which is interposed between said at least one pressure chamber and said at least one supply chamber and which is deformable so that a volume of said at least one pressure chamber is changed, said at least one actuator portion having a communication hole which is formed through a substantially central part thereof, said at least one pressure chamber and said at least one supply chamber communicating with each other through the communication hole.

2. The droplet ejecting apparatus according to claim 1, wherein the communication hole has a size that is so determined as to restrict, upon application of positive pressure to the liquid in said at least one pressure chamber by operation of said at least one actuator portion, propagation of the pressure from said at least one pressure chamber to said at least one supply chamber.

3. The droplet ejecting apparatus according to claim 2, wherein the communication hole has a transverse cross sectional area which is not larger than 1/10 of a transverse cross sectional area of said at least one pressure chamber.

4. The droplet ejecting apparatus according to claim 1, further comprising a first plate having at least one opening which provides said at least one pressure chamber and a second plate having at least one opening which provides said at least one supply chamber, the first plate, the actuator plate having said at least one actuator portion, and the second plate being stacked on one another such that the actuator plate is interposed between the first and second plates.

5. The droplet ejecting apparatus according to claim 4, wherein said at least one opening of the first plate comprises a plurality of openings which respectively provide a plurality of pressure chambers, said at least one actuator portion of the actuator plate comprises a plurality of actuator portions which respectively correspond to the plurality of pressure chambers, said at least one supply chamber of the second plate communicates with the plurality of pressure chambers through respective communication holes of the plurality of actuator portions, and said at least one nozzle comprises a plurality of nozzles which are provided for the plurality of pressure chambers, respectively.

6. The droplet ejecting apparatus according to claim 5, wherein said at least one supply chamber comprises a plurality of supply chambers each of which communicates with a corresponding one of the plurality of pressure chambers through the communication hole formed in a corresponding one of the plurality of actuator portions.

7. The droplet ejecting apparatus according to claim 6, further comprising at least one manifold chamber, the plurality of supply chambers communicating with said at least one manifold chamber.

8. The droplet ejecting apparatus according to claim 1, wherein the actuator plate includes a piezoelectric sheet and at least one non-piezoelectric sheet which are stacked on each other and said at least one actuator portion is a stacked body in which the piezoelectric sheet and said at least one non-piezoelectric sheet are stacked on each other, an entirety of the stacked body being deformed, by deformation of the piezoelectric sheet in a direction perpendicular to a direction of stacking of the stacked body, into a convex shape which protrudes toward at least one of said at least one supply chamber and said at least one pressure chamber, so that the volume of said at least one pressure chamber is changed.

9. The droplet ejecting apparatus according to claim 8, wherein the convex shape of the stacked body is substantially symmetrical with respect to an axis of the communication hole.

10. The droplet ejecting apparatus according to claim 8, further comprising a first plate having at least one opening which provides said at least one pressure chamber and a second plate having at least one opening which provides said at least one supply chamber, the first plate, the actuator plate having said at least one actuator portion, and the second plate being stacked on one another, wherein said at least one opening of the first plate comprises a plurality of openings which respectively provide a plurality of pressure chambers, said at least one actuator portion of the actuator plate comprises a plurality of actuator portions which respectively correspond to the plurality of pressure chambers, said at least one supply chamber of the second plate communicates with the plurality of pressure chambers through respective communication holes of the plurality of actuator portions, and said at least one nozzle comprises a plurality of nozzles which are provided for the plurality of pressure chambers, respectively, and wherein one of said at least one non-piezoelectric sheet of the actuator plate which is formed on one of opposite surfaces of the piezoelectric sheet serves as a common electrode which is common to all of the plurality of pressure chambers, and each of the plurality of actuator portions includes an individual electrode which is formed on the other of the opposite surfaces of the piezoelectric sheet remote from the common electrode and which is provided for a corresponding one of the plurality of pressure chambers.

11. The droplet ejecting apparatus according to claim 10, wherein said one of said at least one non-piezoelectric sheet serving as the common electrode is a metal sheet formed of stainless steel.

12. The droplet ejecting apparatus according to claim 10, wherein said actuator plate further includes an electrically insulating sheet which is stacked on the piezoelectric sheet to cover the individual electrodes.

13. The droplet ejecting apparatus according to claim 10, wherein the individual electrode of each of the plurality of actuator portions has an annular shape so as to surround the communication hole of said each of the plurality of actuator portions.

14. The droplet ejecting apparatus according to claim 10, wherein said at least one supply chamber comprises a plurality of supply chambers each of which communicates with a corresponding one of the plurality of pressure chambers through the communication hole formed in a corresponding one of the plurality of actuator portions.

15. The droplet ejecting apparatus according to claim 1, wherein the communication hole is substantially coaxially opposed to said at least one nozzle via said at least one pressure chamber.

16. The droplet ejecting apparatus according to claim 1, wherein said at least one nozzle has a transverse cross sectional area which increases from one of axially opposite ends of said at least one nozzle that is remote from said at least one pressure chamber toward the other of the axially opposite ends thereof that is on the side of said at least one pressure chamber.

17. The droplet ejecting apparatus according to claim 1, wherein said communication hole of said at least one actuator portion is constituted by a plurality of through-holes.

18. The droplet ejecting apparatus according to claim 1, wherein said communication hole and said at least one pressure chamber has a substantially circular shape in transverse cross section.

19. An ink-jet recording apparatus comprising:

the droplet ejecting apparatus defined in claim 1;

a recording medium supporting member which supports a recording medium on which the droplet ejecting apparatus ejects the droplet of the liquid; and a moving device which relatively moves the droplet ejecting apparatus and the recording medium to each other.

20. The ink-jet recording apparatus according to claim 19, wherein the droplet ejecting apparatus further comprises a first plate having at least one opening which provides said at least one pressure chamber and a second plate having at least one opening which provides said at least one supply chamber, the first plate, the actuator plate having said at least one actuator portion, and the second plate being stacked on one another such that the actuator plate is interposed between the first and second plates.

21. The ink-jet recording apparatus according to claim 19, wherein the actuator plate includes a piezoelectric sheet and at least one non-piezoelectric sheet which are stacked on each other and said at least one actuator portion is a stacked body in which the piezoelectric sheet and said at least one non-piezoelectric sheet are stacked on each other, an entirety of the stacked body of said at least one actuator portion being deformed, by deformation of the piezoelectric film in a direction perpendicular to a direction of stacking of the stacked body, into a convex shape which protrudes toward at least one of said at least one supply chamber and said at least one pressure chamber, so that the volume of said at least one pressure chamber is changed.

22. The ink-jet recording apparatus according to claim 21, wherein the convex shape of the stacked body is substantially symmetrical with respect to an axis of the communication hole.

23. The ink-jet recording apparatus according to claim 21, wherein the droplet ejecting apparatus further comprises a first plate having at least one opening which provides said at least one pressure chamber and a second plate having at least one opening which provides said at least one supply chamber, the first plate, the actuator plate having said at least one actuator portion, and the second plate being stacked on one another, wherein said at least one opening of the first plate comprises a plurality of openings which respectively provide a plurality of pressure chambers, said at least one actuator portion of the actuator plate comprises a plurality of actuator portions which respectively correspond to the plurality of pressure chambers, said at least one supply chamber of the second plate communicates with the plurality of pressure chambers through respective communication holes of the plurality of actuator portions, and said at least one nozzle comprises a plurality of nozzles which are provided for the plurality of pressure chambers, respectively, and wherein one of said at least one non-piezoelectric sheet of the actuator plate which is formed on one of opposite surfaces of the piezoelectric sheet serves as a common electrode which is common to all of the plurality of pressure chambers, and each of the plurality of actuator portions includes an individual electrode which is formed on the other of the opposite surfaces of the piezoelectric sheet remote from the common electrode and which is provided for a corresponding one of the plurality of pressure chambers.

24. The droplet ejecting apparatus according to claim 1, wherein the actuator plate is adapted to receive a voltage signal to deform the at least one actuator portion.

25. The droplet ejecting apparatus according to claim 1, wherein the at least one pressure chamber comprises a plurality of pressure chambers while the at least one actuator portion of the actuator plate comprises a plurality of actuator portions which respectively correspond to the plurality of pressure chambers, and wherein the plurality of pressure chambers communicate with the at least one supply chamber through respective communication holes of the plurality of actuator portions which respectively correspond to the plurality of pressure chambers.

* * * * *